United States Patent [19]

Focke

[11] Patent Number: 4,942,715

[45] Date of Patent: Jul. 24, 1990

[54] APPARATUS FOR THE STABILIZATION AND DRYING OF CUBOID PACKS

[75] Inventor: Heinz Focke, Verden, Fed. Rep. of Germany

[73] Assignee: Focke & Co. (GmbH & Co.), Verden, Fed. Rep. of Germany

[21] Appl. No.: 263,574

[22] Filed: Oct. 27, 1988

[30] Foreign Application Priority Data

Oct. 28, 1987 [DE] Fed. Rep. of Germany ..... 3736403

[51] Int. Cl.[5] ..... B65B 51/10

[52] U.S. Cl. ..... 53/202; 53/234; 53/388

[58] Field of Search ..... 53/575, 234, 387, 388, 53/202; 198/433, 448, 450

[56] References Cited

U.S. PATENT DOCUMENTS 3,590,556 7/1971 Focke ..... 53/575
4,179,864 12/1979 Focke ..... 53/388
4,636,186 1/1987 Focke ..... 53/234 X
4,840,007 6/1989 Focke ..... 53/387 X

FOREIGN PATENT DOCUMENTS 233470 1/1987 European Pat. Off. .
768525 2/1957 United Kingdom ..... 53/575

*Primary Examiner*—John Sipos
*Attorney, Agent, or Firm*—Sughrue, Mion, Zinn, Macpeak & Seas

[57] ABSTRACT

In the production of (cigarette) packs (10, 11) with folding tabs connected by adhesive bonding, dimensional stabilization and drying of the packs (10, 11) in the region of a drying turret (14) are necessary. To increase the capacity of the latter, two concentric pocket rings (17, 18), each with a large number of pockets (15, 16) are provided. The packs (10, 11) are pushed into the pockets (15, 16) in pairs and pushed out of these again likewise. In the region of a pushing-out station (24), the packs (10, 11) are grasped in succession by an intermediate conveyor (60) and fed to a horizontal discharge conveyor (57).

15 Claims, 8 Drawing Sheets

APPARATUS FOR THE STABILIZATION AND DRYING OF CUBOID PACKS

BACKGROUND OF THE INVENTION

The invention relates to an apparatus for the dimensional stabilization and drying of cuboid packs having folding tabs glued to one another, especially of hinge-lid packs for cigarettes, with a (drying) turret which has a plurality of pockets (pocket ring) arranged along a concentric circular path and each for receiving a pack.

With packs which have folding tabs connected to one another by adhesive bonding, after completion it is necessary to carry out treatment for dimensional stabilization and drying. For this purpose, in a packaging machine according to DE-A-No. 2,440,006, the completed and filled packs are fed to a drying turret which has a plurality of pockets arranged along the circumference. In these, the packs are stabilized in terms of their cuboid shape and are dried by the use of heat.

SUMMARY OF THE INVENTION

The invention starts from a drying turret of the abovementioned or a similar design. The object on which the invention is based is to increase the productivity, that is to say the capacity, of a stabilizing and drying station of this type, whilst nevertheless at the same time ensuring a careful treatment of the packs.

To achieve this object, the apparatus according to the invention is characterized in that the drying turret has at least two concentric pocket rings of pockets.

The two concentric rows of pockets virtually double the capacity of the drying turret. The drying turret is therefore especially suitable for two-track packaging machines, in which two packs are accordingly produced simultaneously. The drying turret according to the invention is therefore designed for the simultaneous feeding and emptying of two pockets arranged next to one another in the radial direction.

According to a further feature of the invention, each pocket is equipped with pocket walls resting elastically against a (side) face of the packs, the elastically mounted pocket wall of the outer pockets being arranged on the radially outer side and that of the inner pockets being arranged on the radially inner side. Access to the elastic pocket walls is thereby possible, in order to pull them back from outside in the region of a pushing-in station and of a pushing-out station, thus guaranteeing that the packs will be pushed in and pushed out faultlessly.

After being pushed out, the packs supported in the folding turret for virtually a complete revolution of the latter are transferred to a (horizontal) discharge conveyor, specifically in an upright position with side faces directed downwards and upwards. According to the invention, the procedure is such that one of the two simultaneously ejected packs is transferred directly to an intermediate conveyor, but the second pack is first set down on a conveying platform and then likewise transferred to the intermediate conveyor from this.

Further features relate to the design of the drying turret and of members for pushing in and pushing out the packs and for conveying them away.

An exemplary embodiment of the invention is explained in detail below by means of the drawings. In these:

DETAILED DESCRIPTION OF A PREFERRED EMBODIMENT

Figure 1:
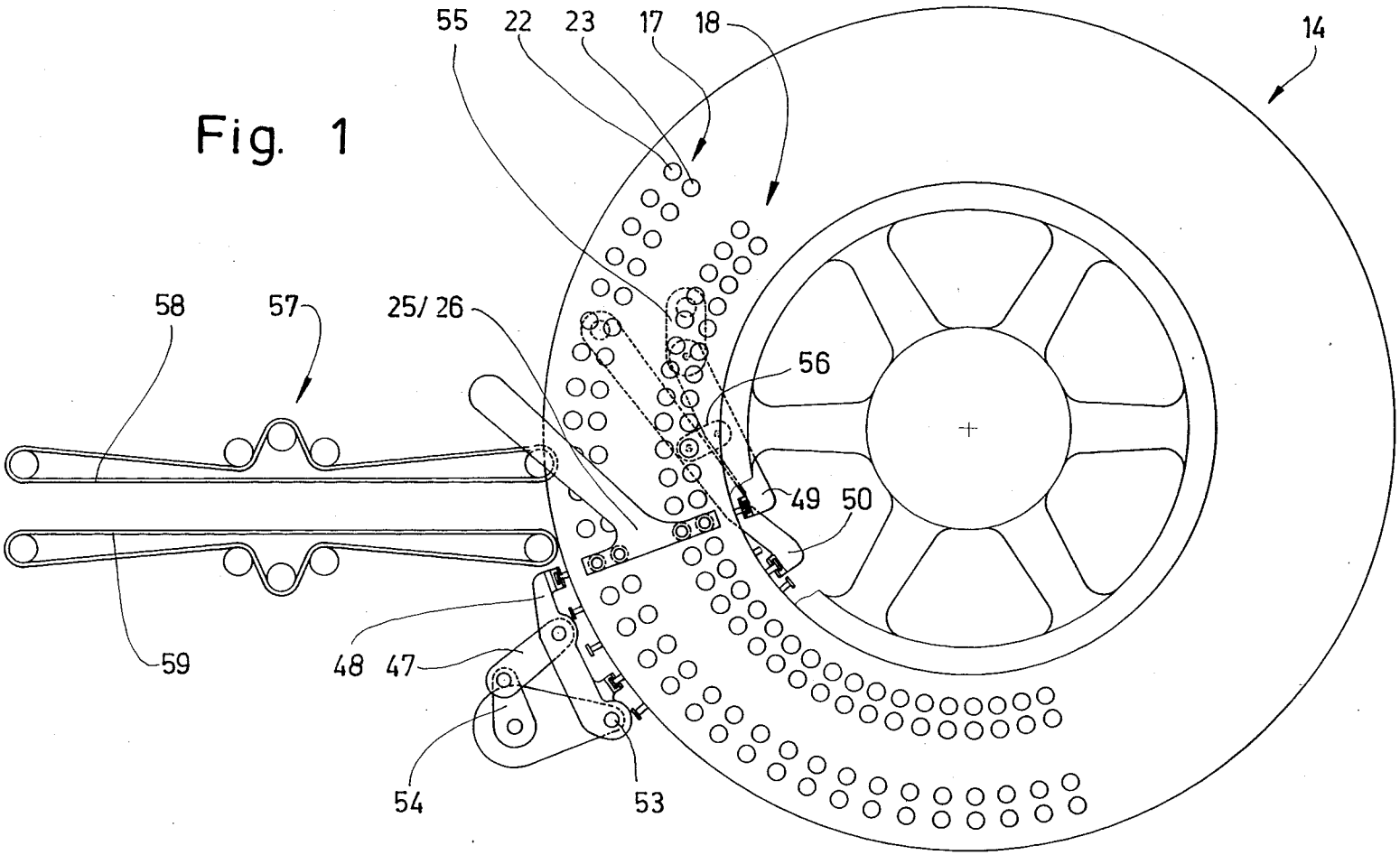
FIG. 1 shows a drying turret with discharge conveyor in a side view from the rear.
Figure 2:
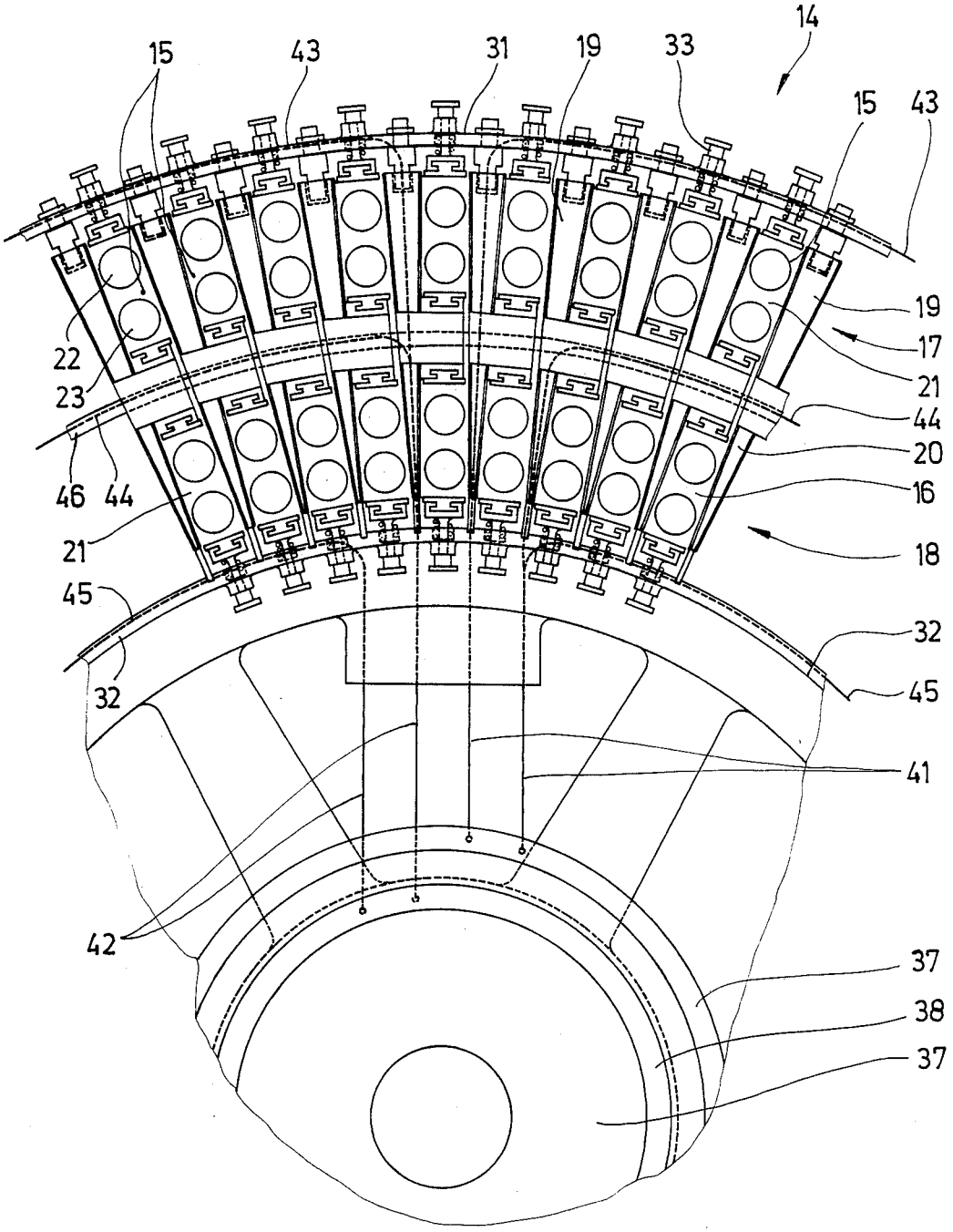
FIG. 2 shows a cutout of the drying turret, as seen from the front, on an enlarged scale.
Figure 3:
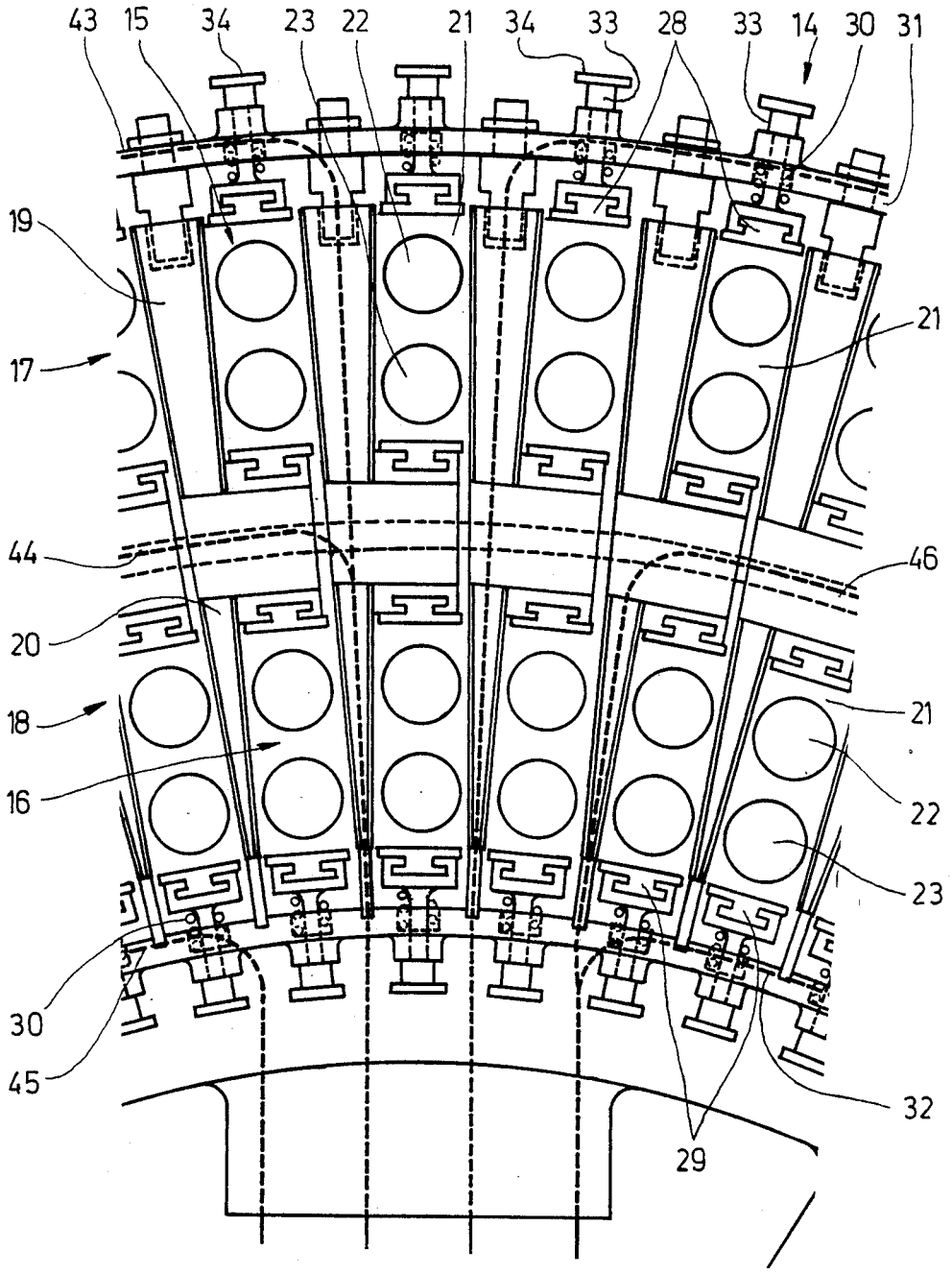
FIG. 3 shows a further-enlarged cutout illustrating the pocket chains in a view according to that of FIG. 2.

The apparatus illustrated in the drawings is an integral part of a packaging machine, especially for the production of cuboid packs 10, 11 (hinge-lid packs) for cigarettes. Moreover, the packaging machine can be designed as in DE-A-No. 2,440,006. In particular, however, the apparatus illustrated is suitable for two-track packaging machines, that is to say for the simultaneous production of two packs 10, 11. The cuboid packs 10, 11 have folding tabs which are connected to one another by adhesive bonding. In hinge-lid packs, such folding tabs glued to one another, particularly side tabs, are located in the region of elongate side walls 12, 13 of the pack 10, 11.

For the stabilization of the shape of the packs 10, 11 and for the hardening of glue spots, the packs 10, 11, after completion, are introduced into a drying turret 14.

The drying turret 14 is designed for the simultaneous reception of two packs 10, 11 and for this purpose is equipped with two series of pockets 15, 16, each for receiving a pack 10, 11. The pockets 15, 16 are arranged in concentric annular paths as pocket rings 17 and 18. The arrangement of these or the relative position of the pockets 15, 16 is such that every two mutually assigned pockets 15 and 16 of the pocket rings 17, 18 are arranged in radial alignment with one another. Wedge-shaped spacer pieces 19, 20 of differing size are arranged between the pockets 15, 16 of the pocket ring 17 on the one hand and of the pocket ring 18 on the other hand, so that the pockets 15 of the pocket ring 17 are at a greater distance from one another than the pockets 16 of the pocket ring 18.

The arrangement and dimensions of the pockets 15, 16 are such that the packs are received in the pockets 15, 16 with the side walls 12, 13 pointing respectively outwards and inwards in the radial direction. The dimension of the pockets 15, 16 corresponds to that of the packs 10, 11, so that their exact cuboid shape is produced or stabilized in the pockets 15, 16.

The pockets 15, 16 are open on one side and at the rear are closed by means of a rear wall 21, with the exception of passage orifices 22, 23. The packs 10, 11 are introduced into the pocket 15, 16 in the axial direction via the open side located opposite the rear wall 21 and are pushed out again in the opposite direction. For this pushing-out, a double tappet 25, 26 is assigned to each of the pockets 15, 16 in the region of a pushing-out station 24. The two double tappets 25 and 26 are connected to one another and are actuated simultaneously. Tappets 27 pass through the passage orifices 22, 23 in the rear wall 21 into the pockets 15, 16 and push the packs 10, 11 out via an end wall (upper wall or base).

The outer pockets 15 of the pocket ring 17, on the radially outer side, and the inner pockets 16 of the inner pocket ring 18, on the radially inner side, are equipped with a movable elastically mounted pocket wall 28, 29. This therefore rests against the respectively outer or inner side wall 12 or 13 of the pack 10, specifically under prestress as a result of compression springs 30 which are supported on the pocket walls 28, 29 on the one hand and on an outer wall 31 or inner wall on the other hand. Tension pins 33 surrounded by the compression springs 30 pass outwards through the outer wall 31 or through the inner wall 32. Attached to the outer ends are respective holding heads 34 which are of approximately T-shaped cross-section and which can be grasped by a tool, in order to move the pocket walls 28, 29 out of contact with the packs 10, 11 via the tension pins 33 connected to the pocket walls 28, 29. In the region of the pushing-out station 24 and in the region of a pushing-in station 35, the pocket walls 28, 29 are pulled back radially outwards and inwards respectively in the way described, in order to make it possible to push in and push out the packs 10, 11.

The pockets 15 and 16 are heated, specifically by means of electrical resistance heating. For this purpose, the drying turret 14 is equipped, adjacent to a turret hub 36, with two concentric slip rings 37, 38. Stationary brush electrodes 39, 40 (carbon electrodes) rest against these. The latter are supplied with current. Electrical lines 41, 42 lead from the slip rings 37, 38 to concentric heating strips 43, 44 and 45. These are arranged in the region of the annular outer wall 31 and inner wall 32 and of an intermediate wall 46. The heating strips 43, 44 and 45 are encircling and therefore heat all the pockets 15, 16.

Figure 4:
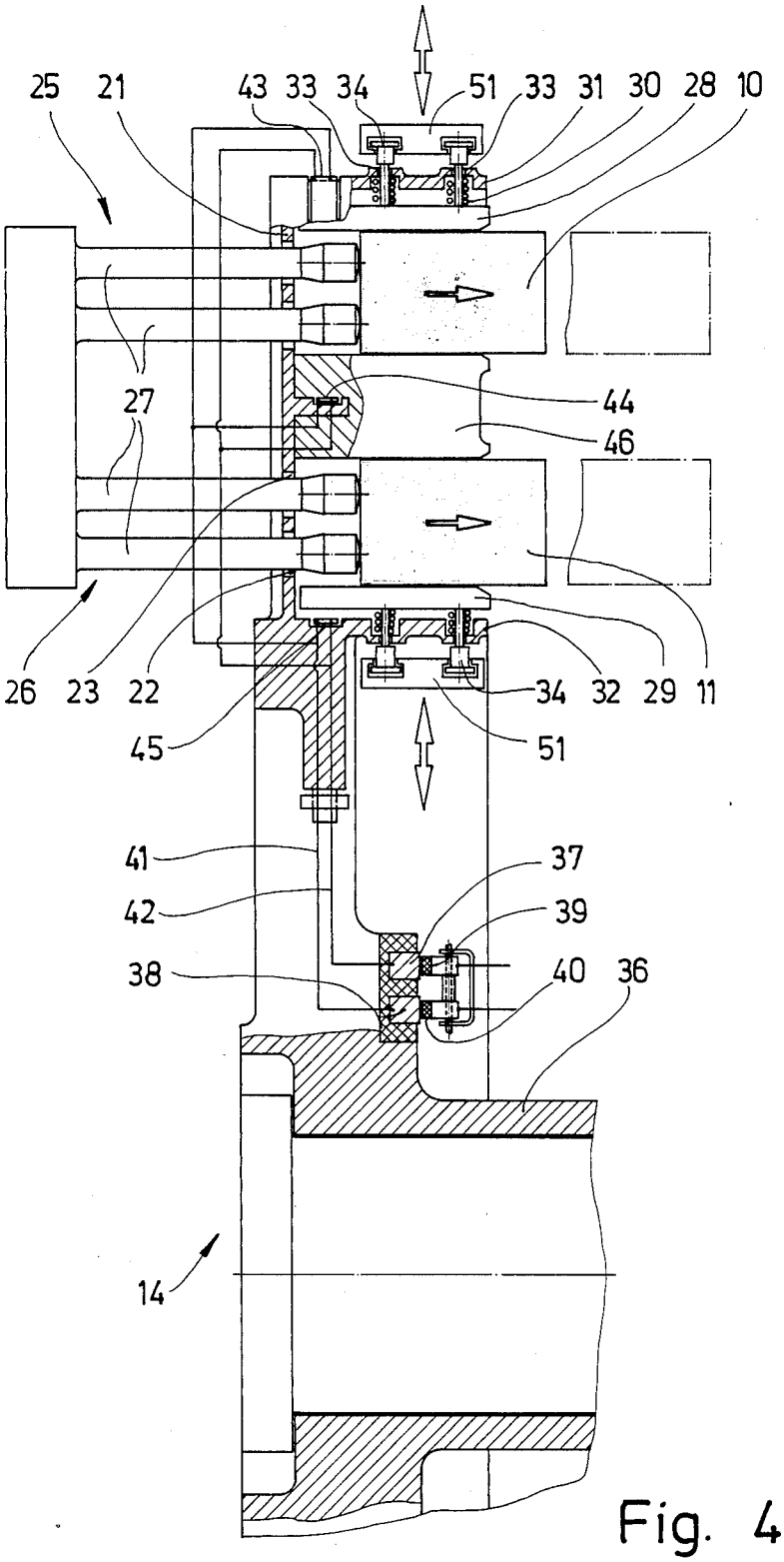
FIG. 4 shows a cutout of the drying turret according to FIG. 2 in radial section.

In the present exemplary embodiment, for lifting the pocket walls 28 and 29 via the spring-loaded tension pins 33, there are lifting levers arranged fixed in place on the outside and inside of the drying turret 14, in particular outer lifting levers 47 and 48 and inner lifting levers 49 and 50. The lifting levers 47 to 50 are equipped at the ends with claws 51. The holding heads 34 of the tension pins 33 enter these as a result of the rotary movement of the drying turret 14 in the pushing-out station 24 and the pushing-in station 35. As a result of the design of the claws 51, the holding heads 34 are grasped positively in these stations. As a result of a pivoting movement of the lifting levers 47 to 50, the tension pins 33 of the pockets 15, 16 are pulled outwards or inwards in the radial direction in the region of the pushing-out station 24 and of the pushing-in station 35, with the result that the pocket walls 28, 29 are lifted off from the side walls 12, 13 of the packs 10, 11. The packs 10 can now be pushed into the pockets 15, 16 or pushed out of these. For grasping the two holding heads 34 of each pocket wall 28, 29, the claw 51 is designed with an appropriate width or as a double claw, as is evident from FIG. 4.

According to a particular feature regarding the actuation of the lifting levers 47 to 50, the outer lifting levers 47, 48 and the inner lifting levers 49, 50 are respectively connected to one another in transmission terms. In the present case, the outer lifting lever 47 is designed as an angle lever and is connected via a pivot bearing 52 to the second outer lifting lever 48. The latter is mounted fixed in place in a pivot bearing 53. The free leg of the outer lifting lever 47 is connected to a crank arm 54 movable to and fro. Pivoting movements of the latter are thus transmitted to the outer lifting lever 47 and from this at the same time to the outer lifting lever 48. The outer lifting lever 47 is assigned to the pushing-in station 35 and the outer lifting lever 48 to the pushing-out station 24.

The inner lifting levers 49, 50 are designed in a similar way (FIG. 1). The inner lifting lever 49 assigned to the pushing-out station 24 is driven by a crank arm 55 movable to and fro. The pivoting movements of the inner lifting lever 49 are transmitted via a link 56 to the inner lifting lever 50 assigned to the pushing-in station 35.

The pushing-out station 24 is located in a radial plane below the (imaginary) horizontal mid-plane of the drying turret 14 rotating in a vertical plane. The packs 10, 11, after coming out of the drying turret 14, are transferred to a discharge conveyor 57 which consists of an upper and lower conveyor belt with a horizontal upper strand 58 and lower strand 59. The packs 10, 11 are conveyed between the upper strand 58 and lower strand 59 at a distance from one another, specifically in an upright position, so that the side walls 12, 13 rest against the upper strand 58 and lower strand 59 respectively.

In order to obtain this position for the packs 10, 11, the packs 10, 11, after coming out of the drying turret 14, are transferred to an intermediate conveyor 60 which transfers the packs 10, 11 individually to the discharge conveyor 57 along a conveying path in the form of an arc of a circle. During transport in the intermediate conveyor 60, the packs 10, 11 are brought out of the position lying flat into the erect position.

Figure 7:
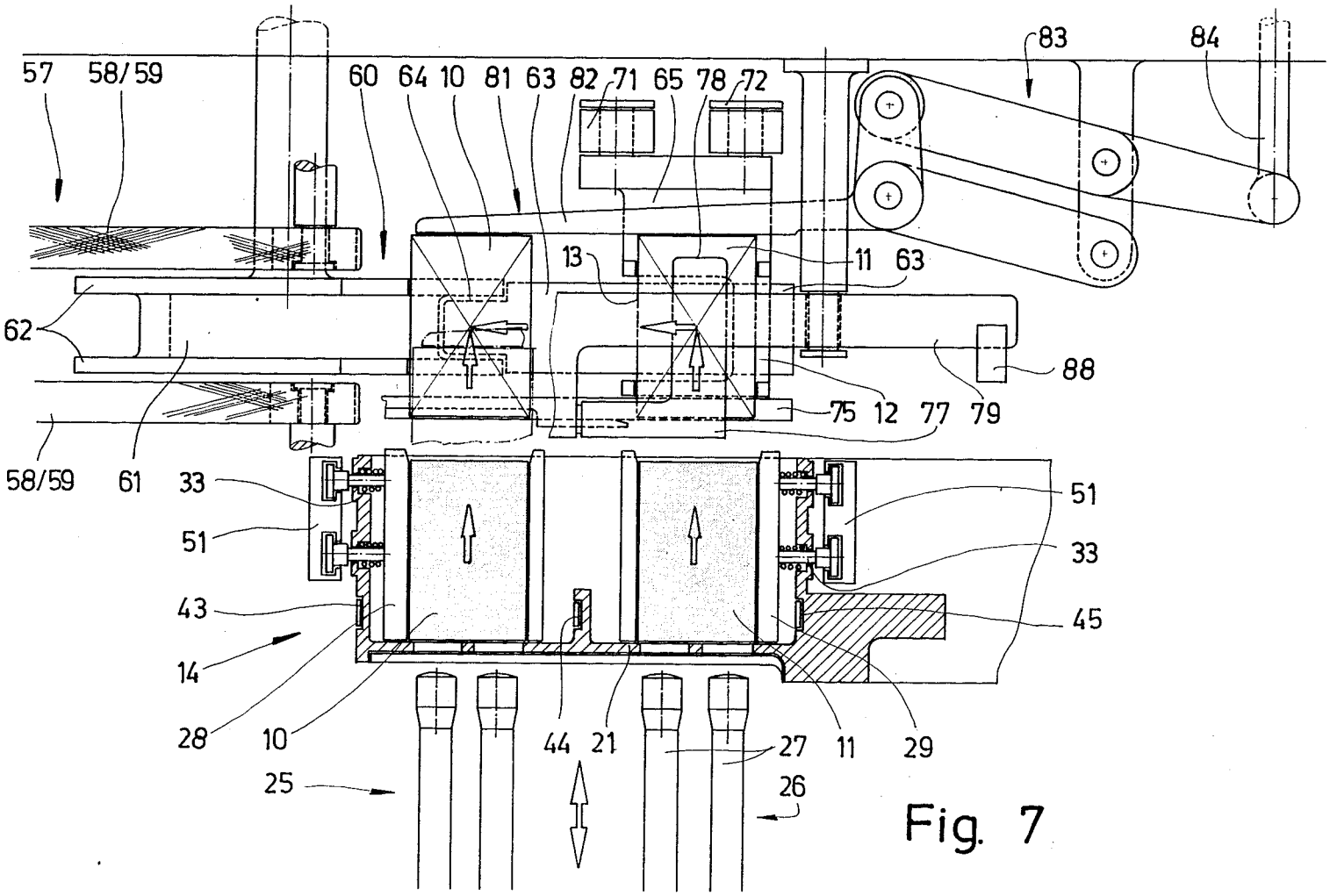
FIG. 7 shows a plan-view representation in the region of the pushing-out station with a radial section through the folding turret.

The intermediate conveyor 60 is designed as a continuously rotating conveyor wheel with elongate take-up arms 62. As is evident from FIG. 7, the conveyor wheel 61 is designed in the manner of a yarn spool, with the result that two respective take-up arms 62 arranged at a distance from one another and intended for grasping a pack 10, 11 in the region of a front wall or rear wall are obtained.

The intermediate conveyor 60 is mounted fixed in place, in particular in the region of the pushing-out station 24, next to the outer circumference of the drying turret 14, specifically in such a way that the packs 10 pushed out of the radially outer pockets 15 each pass directly onto a take-up arm 62 of the conveyor wheel 61. The movements are coordinated with one another in such a way that the pack 10 is in a receiving position for the intermediate conveyor 60 when a take-up arm 62 comes into this region from below as a result of the rotation of the conveyor wheel 61. The respective pack 10 is then conveyed approximately over a quarter circle and then passes into the entry side of the discharge conveyor 57.

The transfer of the packs 10, 11 from the conveyor wheel 61 to the discharge conveyor 57 is made easier because the latter consists of two respective conveyor bands located next to one another, that is to say also in the region of the upper strand 58 and lower strand 59. A part region of the intermediate conveyor 60 extends between the conveyor bands. The packs can thereby be conveyed into a position favourable for discharge between the upper strand 58 and lower strand 59.

The pack 11 pushed out of the drying turret 14 simultaneously is set down at a distance from the circumference of the intermediate conveyor 60 and is then shifted transversely into a position for reception by a following take-up arm 62 of the conveyor wheel 61.

For the successive feeding of the packs 10, 11 to the intermediate conveyor 60, a platform 63 is arranged in the region of the pushing-out station 24 next to the drying turret 14 in the pushing-out direction of the packs 10, 11. This platform 63 extends as a tongue-like supporting member for the two packs 10, 11 into the region of the conveyor wheel 61. By means of an extension piece 64 of smaller width the platform 63 projects between the two parts of the take-up arms 62 of the conveyor wheel 61.

The outer pack 10, when pushed out of the drying turret 10 (sic), is set down directly on this region of the platform 63. The second pack 11 is then shifted in the direction of the conveyor wheel 61 on the platform 63, specifically by means of a slide member 65 movable to and fro and acting from the underside. The latter consists essentially of four vertical take-up pins 67, 68 which are connected by means of a U-shaped frame 66 to form a unit and which respectively grasp the pack 11 on the side wall 12 at the rear in relation to the conveying direction and guide it on the opposite side wall 13, so that the pack 11 is moved precisely and in the exact position. The take-up pins 67 and 68 are at such a distance from one another that they extend on both sides of the platform 63 and can also be moved into a position on both sides of the conveyor wheel 61.

Figure 6:
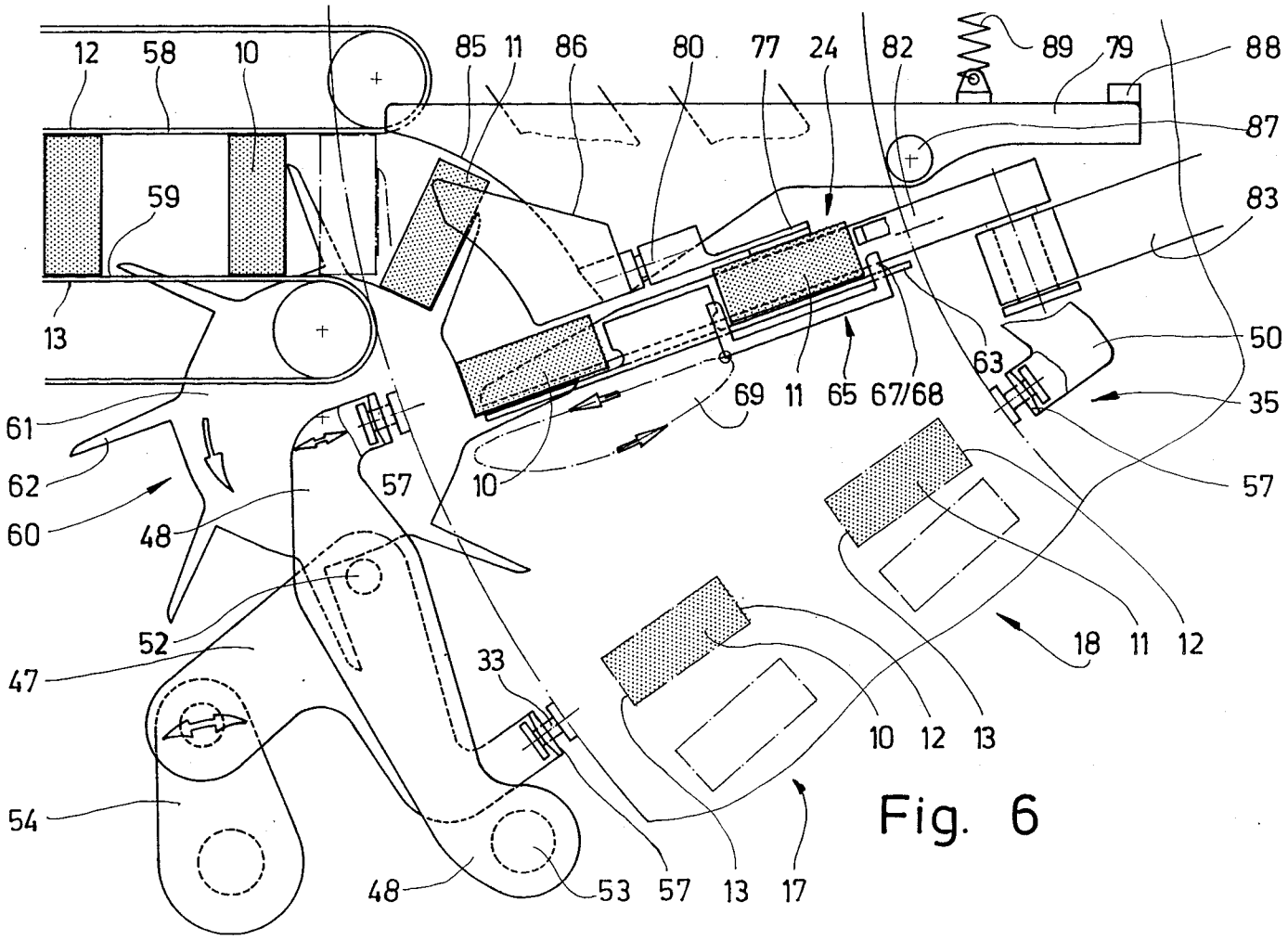
FIG. 6 shows a cutout of the detail according to FIG. 5 on an enlarged scale.

The slide member 65 is arranged underneath the platform 63, is moved upwards in order to take up a pack 11 and is then moved (radially) in a straight line together with this. In the end position, in particular after the pack 11 has been transferred to the intermediate conveyor 60, the take-up member 65 is lowered and guided back into the initial position underneath the platform 63. The D-shaped movement curve 69 is shown in FIG. 6.

Figure 5:
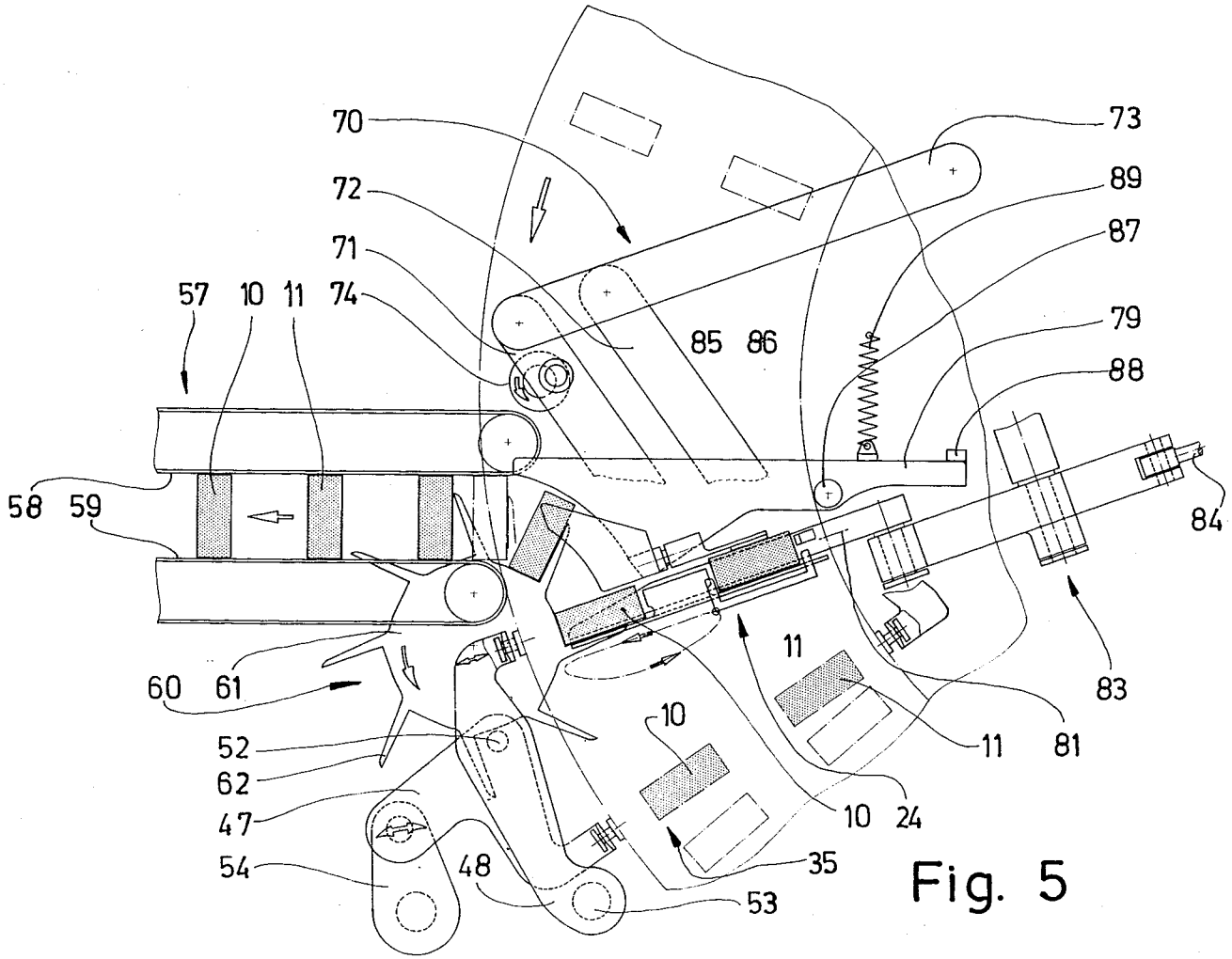
FIG. 5 shows a side view of a pushing-in station and pushing-out station with a simplified cutout of the folding turret.

For executing the above-described movement of the slide member 65, the latter is mounted pivotably on a crank-and-rocker mechanism 70 which is driven so as to rock to and fro in a plane parallel to the plane of the drying turret 14. The crank-and-rocker mechanism 70 contains two rocker arms 71 and 72 which at the free ends are articulated on the slide member 65 and at the other ends are fastened to a pivotably mounted coupling arm 73. The crank-and-rocker mechanism 70 is driven by a crank 74 (FIG. 5) which engages on the rocker arm 71.

The platform 63 extending next to the drying turret 14 in the region of the pushing-out station 24 has an inclination descending radially outwards. In order to set the packs 10, 11 down on the platform 63 in an exact relative position and feed them to the intermediate conveyor 60, further holding and guide members are provided. Next to the platform 63 which has a smaller width than the dimension of the packs 10, 11, a lower guide 75 for the packs 11, 12 extends laterally, facing the drying turret 14, at a distance from the platform 63, so that the take-up pins 67, 68 can be moved between the platform 63 and the lower guide 75. The lower guide 75, in part regions, particularly in the region between the packs 10, 11 pushed out simultaneously, is equipped with a lateral guide 76 adjoining it angularly. The radially inner pack 11 pushed out is moved past the latter when it is fed to the intermediate conveyor 60.

An upper guide 77 of angular shape in horizontal projection (FIG. 7) takes effect in the region of the pack 11 during or after the pushing-out from the drying turret 14. The upper guide 77 consists of a tongue 78 extending horizontally or in the plane of the topside of the pack 11 and mounted so as to be laterally pivotable, in particular on a pivoting arm 79 which is mounted at a distance above the platform 63 and which also carries further members. An axis of rotation 80 of the upper guide 77 extends parallel to the conveying direction of the pack 11 on the platform 63. The upper guide 77 or its tongue 78 rests on the pack 11 under its own weight and thereby stabilizes the exact position of the latter on the platform 63.

Figure 8:
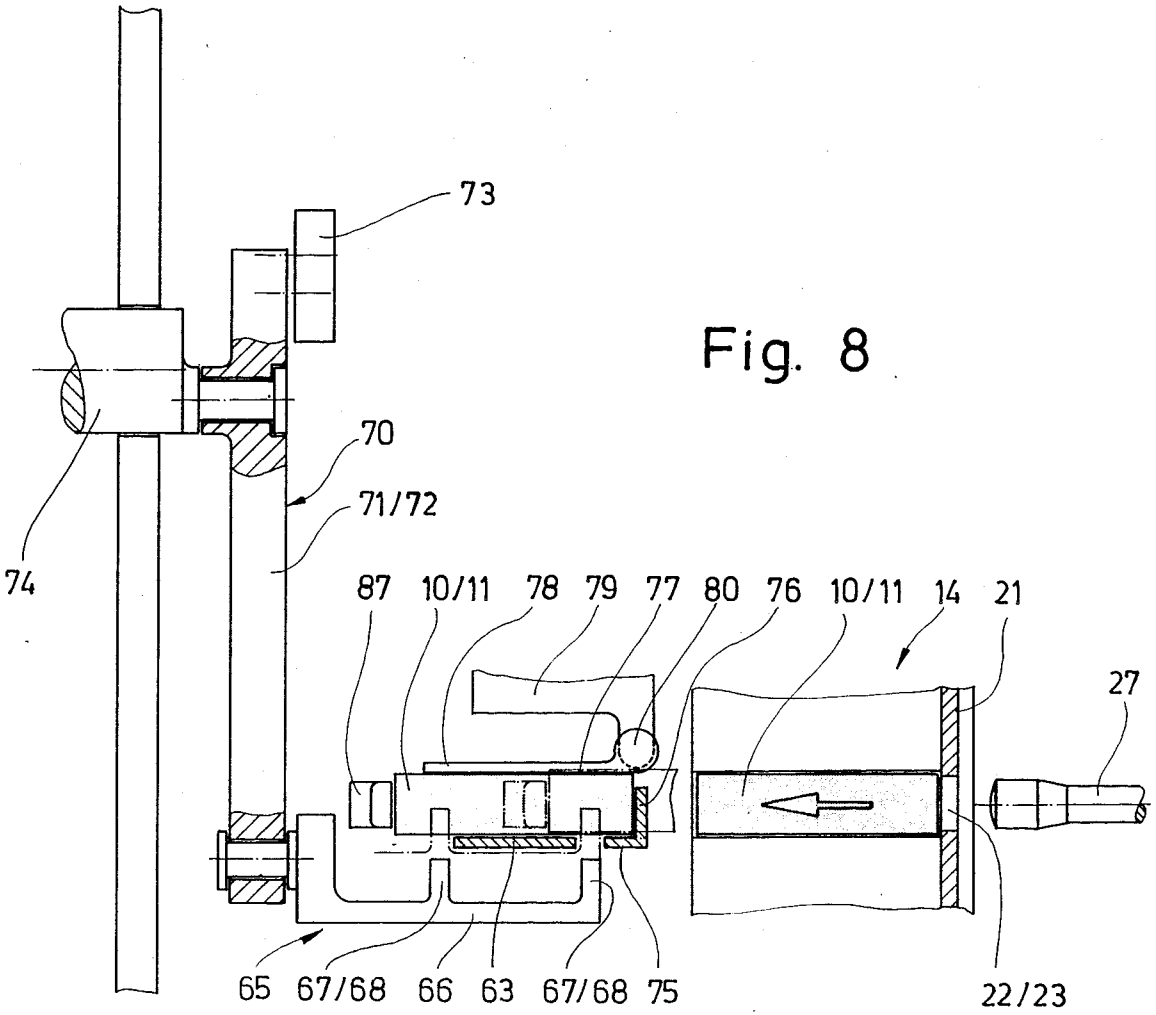
FIG. 8 shows a view or section of a detail of FIG. 7, offset 90° relative to FIG. 7.

In order to prevent adverse effects as a result of the high pushing-out speed of the packs 10, 11 from the drying turret 14, a common collector 81 is assigned to the two packs. This consists, here, of an angular collecting arm 82 which is moved counter to the packs 10, 11 at the start of the pushing-out movement of the latter (FIG. 8). With the packs resting against the collecting arm 82, the pushing-out movement is then continued, the collecting arm 82 returning to the initial position (FIG. 7) with the same movement as the packs 10, 11.

For this purpose, the collecting arm 82 is mounted on a parallelogram linkage 83 which is mounted fixed in place at the free ends and which is driven to rock to and fro by means of a connecting rod 84.

In the region of the intermediate conveyor 60, care is taken to ensure that the packs 10, 11 are guided in an orderly manner after being received by the conveyor wheel 61. Formed on the already mentioned pivoting arm 79 for this purpose is an outer guide 85. This is in the form of an arc of a circle and limits the outer path of movement of the packs 10, 11 during transport by the conveyor wheel 61. As is evident from FIG. 6, the outer guide 85 remains at a short distance from the packs 10, 11. Only in the event of outward shifts do the packs 10, 11 come up against the outer guide 85 during transport by the conveyor wheel 61. As illustrated, this outer guide 85 is designed as part of or as an end region of the pivoting arm 79. The pivoting arm 79 itself extends above the platform 63.

Furthermore, mounted on the pivoting arm 79 or on the part forming the outer guide 85 is a lateral guide piece 86. This forms a lateral guide for the packs 10, 11 during transport by the conveyor wheel 61, specifically on the side facing the drying turret 14. To that extent, the lateral guide piece 86 is a counterpart to the collector 81. The lateral guide piece 86 prevents shifts of the packs 10, 11 on the take-up arms 62 in the axial direction relative to the conveyor wheel 61.

The outer guide 85 and the lateral guide piece 86 as well as the upper guide 77 are movable as a result of the arrangement of the pivoting arm 79. This prevents machine parts from breaking in the event of build-ups as a result of incorrectly transported or formed packs 10, 11. As is evident, the pivoting arm 79 is designed as a two-armed lever and is pivotable about a lever bearing 87. A free end of the pivoting arm 79 rests against a fixed stop 88, specifically as a result of the effect of a tension spring 89. The pivoting arm 79 is therefore pulled up against the stop 88 by the tension spring 89. Under an increased load on the outer guide 85 and/or the lateral guide piece 86, the pivoting arm 79 is pivoted in the clockwise direction (FIG. 5) counter to the load of the tension spring 89, so that the respective members move away and avoid being broken.

What is claimed is:

1. Apparatus for the dimensional stabilization and drying of hinge-lid cuboid packs having folding tabs glued to one another, said apparatus including a drying turret which has a plurality of pockets forming a pocket ring arranged along a concentric circular path, each pocket being adapted to receive a pack, said apparatus being characterized in that:

the drying turret (14) has at least two concentric pocket rings (17, 18) of pockets (15, 16);

the pockets (15, 16) of the pocket rings (17, 18) are aligned with one another in pairs in common radial planes;

in the outer pocket ring (17), a radially outer pocket wall (28) and, in the inner pocket ring (18), a radially inner pocket wall (29) is mounted resiliently and is movable outwards and inwards respectively;

in a pushing-out station (24) and in a pushing-in station (35) of the drying turret (14), the resilient pocket walls (28, 29) are equipped with actuating means, in the form of outwardly directed tension pins (33), and are moved to enlarge the pocket by stationary actuating members during operation of the apparatus;

there is provided means for pushing the packs (10, 11) out of the pockets (15, 16) of the drying turret (14) in an axial direction in the pushing-out station (24) and transferring them to a horizontal discharge conveyor (57) and individually conveying them away thereby in an upright position with narrow side walls (12, 13) of the packs directed downwards and upwards;

there is provided an intermediate conveyor (60) for feeding the packs (10, 11) pushed out of the pockets (15, 16) of the drying turret (14) to the discharge conveyor (57); and the intermediate conveyor (60) is a continuously rotating conveyor wheel (61) with projecting take-up arms (62), and packs (10, 11) are grasped in succession by the take-up arms (62) and fed to the discharge conveyor (57) along a path in the form of an arc of a circle.

2. Apparatus according to claim 1, characterized in that the packs (10, 11) pushed out simultaneously are set down on an intermediate carrier arranged next to the drying turret (14), on a stationary platform (63) extending in the radial direction.

3. Apparatus according to claim 2, characterized in that the radially outer packs (10), after being pushed out of the pocket (15), is set down on the platform (63) in a region located in the range of movement of the intermediate conveyor (60) in such a way that the pack (10) is lifted off directly from the platform (63) by the take-up arms (62).

4. Apparatus according to claim 2, characterized in that the second radially inner pack (11), after being pushed out of the pocket (16), are set down on the platform (63) and fed to the intermediate conveyor (60) by a slide member (65) acting in the radial direction.

5. Apparatus according to claim 4, characterized in that the slide member (65) is movable underneath the platform (63), and take-up means, in the form of vertical take-up pins (67, 68) extending on both sides of the platform (63), grasp the pack (11) and take it on the platform (63) into the position for reception by the intermediate conveyor (60), and in the take-up pins (67, 68) are conveyed back into the initial position outside the path of movement of the pack (11).

6. Apparatus according to claim 2, characterized in that the platform (63) has assigned to it guiding and leading members for a pack (11) distant from the intermediate conveyor (60) after being pushed out, in the form of a lower guide (75) and lateral guides 76).

7. Apparatus according to claim 6, characterized in that the pack (11) distant from the intermediate conveyor (60) after being pushed out has assigned to it, on the platform (63), an upper guide (77) which is movable, movable, pivotable along a radial axis, and which rests on the pack (11) essentially under its own weight.

8. Apparatus according to claim 7, characterized in that, during transport by the intermediate conveyor (60) the packs (10, 11) are guided on the radial outer side of the latter, by an outer guide (85) with a guide edge in the form of an arc of a circle, as part of a pivoting arm (79) movable counter to a spring load 89.

9. Apparatus according to claim 8, characterized in that a lateral guide (86) is mounted on the pivoting arm (79), for guiding the packs (10, 11) in the region of the end faces during transport by the intermediate conveyor (60).

10. Apparatus according to claim 8, characterized in that the upper guide (77) is mounted on the pivoting arm (79).

11. Apparatus for the dimensional stabilization and drying of hinge-lid cuboid packs having folding tabs glued to one another, said apparatus including a drying turret which has a plurality of pockets forming a pocket ring arranged along a concentric circular path, each pocket being adapted to receive a pack, said apparatus being characterized in that:

the drying turret (14) has at least two concentric pocket rings (17, 18) of pockets (15, 26);

the pockets (15, 16) of the pocket rings (17, 18) are aligned with one another in pairs in common radial planes;

in the outer pocket ring (17), a radially outer pocket wall (28) and, in the inner pocket ring (18), a radially inner pocket wall (29) is mounted resiliently and is movable outwards and inwards respectively;

in a pushing-out station (24) and in a pushing-in station (35) of the drying turret (14), the resilient pocket walls (28, 29) are equipped with actuating means, in the form of outwardly directed tension pins (33), and are moved to enlarge the pocket by stationary actuating members during operation of the apparatus;

there is provided means for pushing the packs (10, 11) out of the pockets (15, 16) of the drying turret (14) in an axial direction in the pushing-out station (24) and transferring them to a horizontal discharge conveyor (57) and individually conveying them away thereby in an upright position with narrow side walls (12, 13) of the packs directed downwards and upwards; and against a bearing member moving with the packs in the pushing-out against a collector (81) movable to and fro and having a collecting arm (82) which moves with the packs (10, 11) during the pushing-out movement and against which the packs rest.

12. Apparatus for the dimensional stabilization and drying of hinge-lid cuboid packs having folding tabs glued to one another, said apparatus including a drying turret which has a plurality of pockets forming a pocket ring arranged along a concentric circular path, each pocket being adapted to receive a pack, said apparatus being characterized in that:

the drying turret (14) has at least two concentric pocket rings (17, 18) of pockets (15, 16);

the pockets (15, 16) of the pocket rings (17, 18) are aligned with one another in pairs in common radial planes;

in the outer pocket ring (17) a radially outer resilient pocket wall (28), and in the inner pocket ring (18) a radially inner resilient pocket wall (29), rest against and clamp a received pack (10, 11) and are outwardly and inwardly movable for releasing the clamping of the pack;

there are provided stationary actuating members, in a pushing-out station (24) and in a pushing-in station (35) of the drying turret (14) for enlarging the resilient pocket walls (28, 29) via actuating means (33) thereon, in order to temporarily neutralize the clamping effect of said pocket walls (28, 29) during operation of the apparatus; and in the region of the pushing-out station (24), there is provided at least one tappet (25, 26) which is movable into the pockets (15, 16), via passage orifices (22, 23) in a rear wall (21) of the drying turret (14), to push out the packs (10, 11);

wherein the actuating means of the resilient pocket walls (28, 29) are in the form of outwardly directed tension pins (33); and wherein the pushing-out station (24) and the pushing-in station (35) of the drying turret (14) are arranged adjacent to one another, at a distance from one another corresponding to two pockets (15, 16), with stationary pivotable lifting levers (47, 48; 59, 50) being arranged on the outside and on the inside of said turret for the actuation of said tension pins (33, 34) with a holding head, said tension pins (33, 34) being connected to the pocket walls (28, 29), two outer lifting levers (47, 48) and two respective inner lifting levers (49, 50) being connected to one another in transmission terms and being jointly actuable.

13. Apparatus according to claim 12, wherein each tappet (25, 26) comprises a double tappet.

14. Apparatus according to claim 12, wherein an outer wall (31) of the drying turret (14) and a correspondingly designed inner wall (32) and an intermediate wall (46) arranged between the two pocket rings (17, 18) are each equipped with a heating device.

15. Apparatus according to claim 14, wherein the heating device comprises encircling heating strips (43, 44, 45).

* * * * *